US012576473B2

(12) United States Patent
Ueno et al.

(10) Patent No.: US 12,576,473 B2
(45) Date of Patent: Mar. 17, 2026

(54) SINGLE-SIDE POLISHING APPARATUS, SINGLE-SIDE POLISHING METHOD, AND POLISHING PAD

(71) Applicant: SHIN-ETSU HANDOTAI CO., LTD., Tokyo (JP)

(72) Inventors: Junichi Ueno, Shirakawa (JP); Kaoru Ishii, Shirakawa (JP)

(73) Assignee: SHIN-ETSU HANDOTAI CO., LTD., Tokyo (JP)

( * ) Notice: Subject to any disclaimer, the term of this patent is extended or adjusted under 35 U.S.C. 154(b) by 440 days.

(21) Appl. No.: 18/012,711

(22) PCT Filed: May 24, 2021

(86) PCT No.: PCT/JP2021/019647
§ 371 (c)(1),
(2) Date: Dec. 23, 2022

(87) PCT Pub. No.: WO2022/014167
PCT Pub. Date: Jan. 20, 2022

(65) Prior Publication Data

US 2023/0330804 A1 Oct. 19, 2023

(30) Foreign Application Priority Data

Jul. 13, 2020 (JP) ..... 2020-120134

(51) Int. Cl.
*B24B 37/20* (2012.01)

(52) U.S. Cl.
CPC ..... *B24B 37/20* (2013.01)

(58) Field of Classification Search
CPC . H01L 21/304; H01L 21/30625; B24B 7/228; B24B 37/04; B24B 37/042;
(Continued)

(56) References Cited

U.S. PATENT DOCUMENTS 5,961,378 A 10/1999 Inaba
6,616,520 B1 9/2003 Kawahara et al.
(Continued)

FOREIGN PATENT DOCUMENTS

JP S61-241059 A 10/1986
JP H10-225863 A 8/1998
(Continued)

OTHER PUBLICATIONS

Jul. 9, 2024 Extended Search Report issued in European Patent Application No. 21842421.6.
(Continued)

*Primary Examiner* — Robert F Neibaur
(74) *Attorney, Agent, or Firm* — Oliff PLC

(57) ABSTRACT

A single-side polishing apparatus including: a base turntable having a groove for vacuum suction; a detachable polishing turntable immobilized by vacuum suction; a polishing pad; and a polishing head configured to hold a wafer. The single-side polishing apparatus brings a surface of a wafer held by the polishing head into sliding contact with the polishing pad for polishing. The polishing pad includes a polishing layer configured to polish the wafer surface, a first adhesive layer, a PET sheet layer, a second adhesive layer, an elastic layer, and a third adhesive layer for attachment to the polishing turntable. The layers are sequentially stacked. The polishing pad has a compressibility of 16% or more.

9 Claims, 4 Drawing Sheets

(58) Field of Classification Search
CPC ..... B24B 37/30; B24B 37/22; B24B 37/24; B24B 37/26
USPC ..... 451/41, 287, 288, 289
See application file for complete search history.

(56) References Cited

U.S. PATENT DOCUMENTS

| | | | | |
|---|---|---|---|---|
| 6,835,118 | B2 * | 12/2004 | Berkstresser | B24D 9/10 451/28 |
| 9,193,026 | B2 * | 11/2015 | Schwandner | B24B 37/042 |
| 9,296,087 | B2 * | 3/2016 | Staudhammer | B24B 53/017 |
| 2004/0137831 | A1 | 7/2004 | Kollodge et al. | |
| 2017/0144266 | A1 * | 5/2017 | Sato | H01L 21/30625 |
| 2018/0207770 | A1 | 7/2018 | Tolles et al. | |

FOREIGN PATENT DOCUMENTS

| | | | |
|---|---|---|---|
| JP | H11-277408 | A | 10/1999 |
| JP | 3166396 | B2 | 5/2001 |
| KR | 2017-0005011 | A | 1/2017 |

OTHER PUBLICATIONS

Aug. 3, 2021 International Search Report issued in International Patent Application No. PCT/JP2021/019647.
Jan. 17, 2023 International Preliminary Report on Patentability issued in International Patent Application No. PCT/JP2021/019647.
Mar. 18, 2025 Office Action issued in Korean Patent Application No. 10-2022-7045750.

* cited by examiner

[FIG. 1]
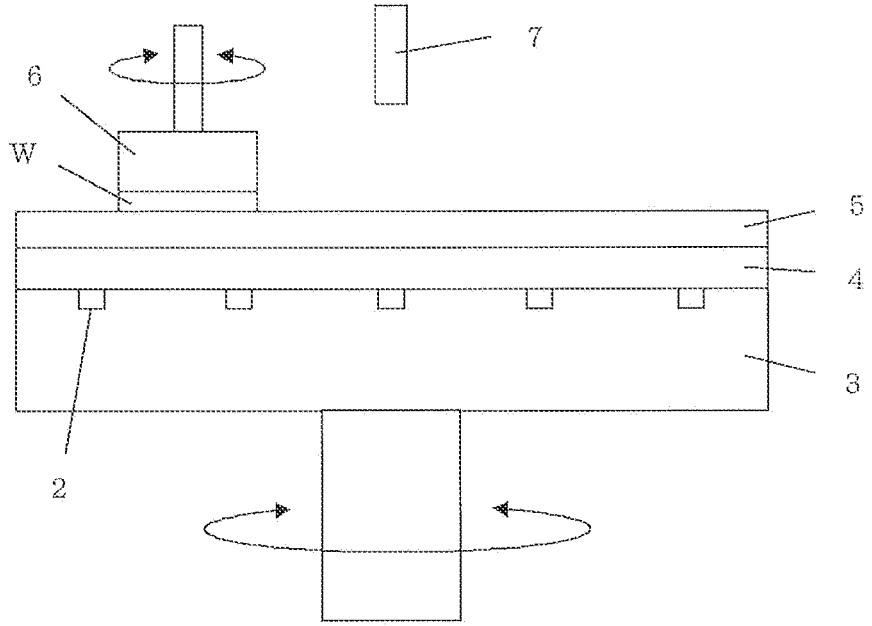
[FIG. 2]
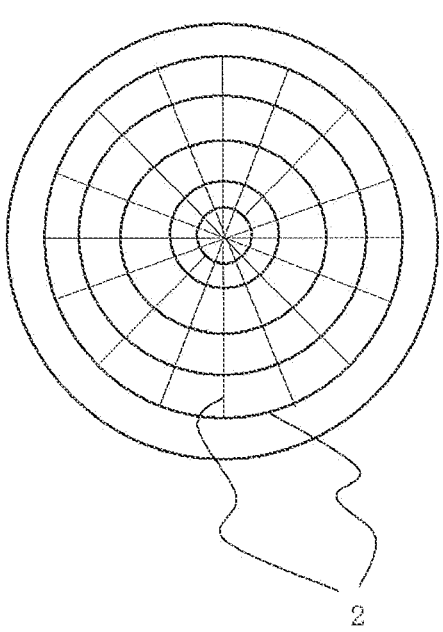

[FIG. 3]
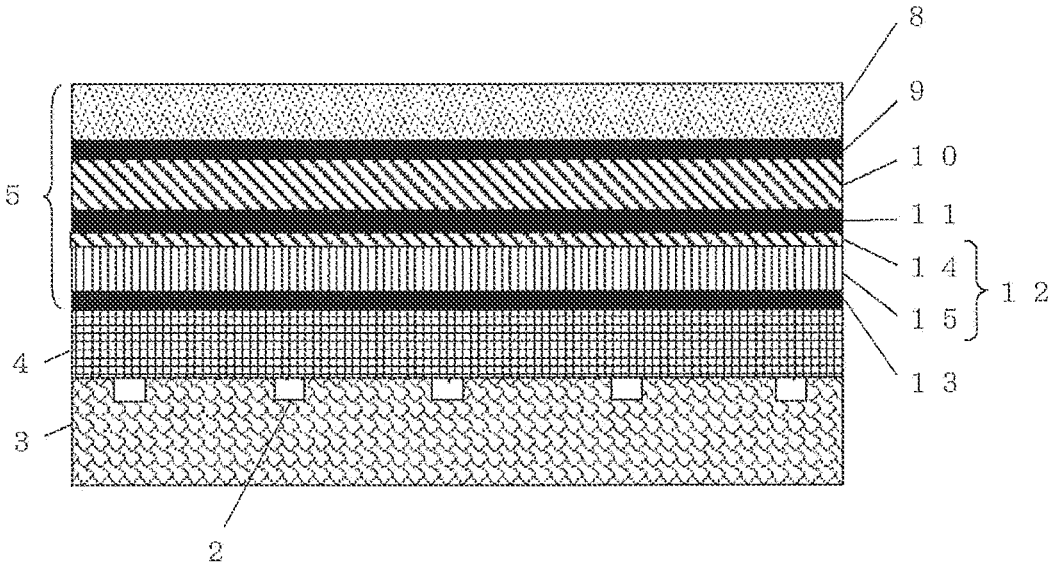
[FIG. 4]
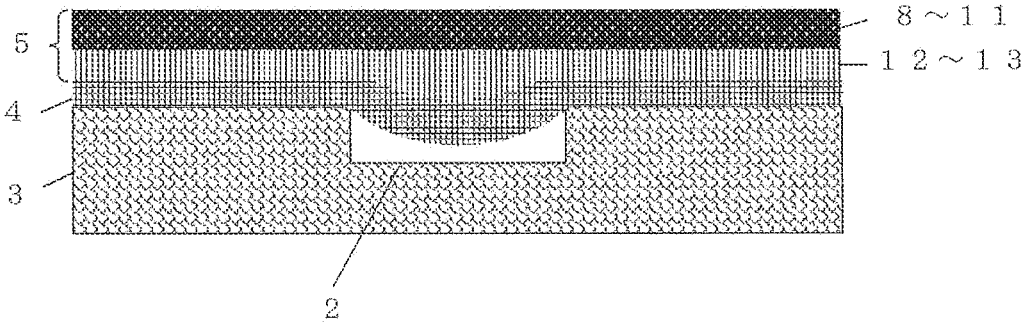
[FIG. 5]
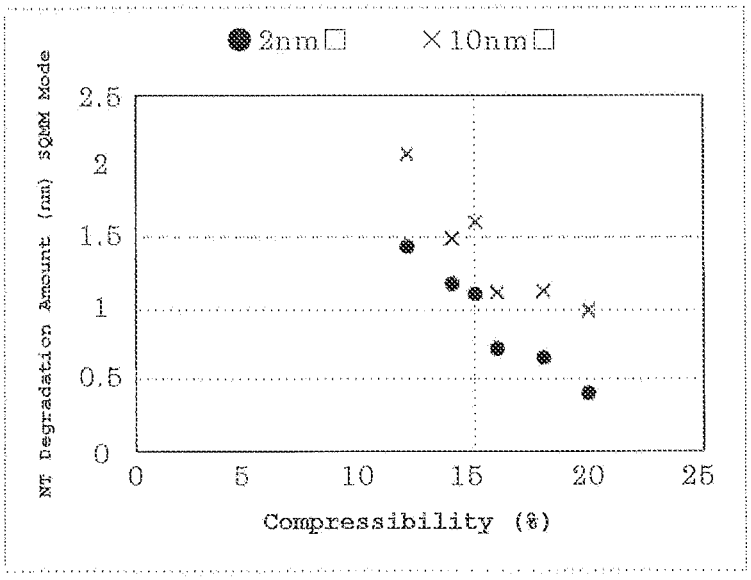

[FIG. 6]
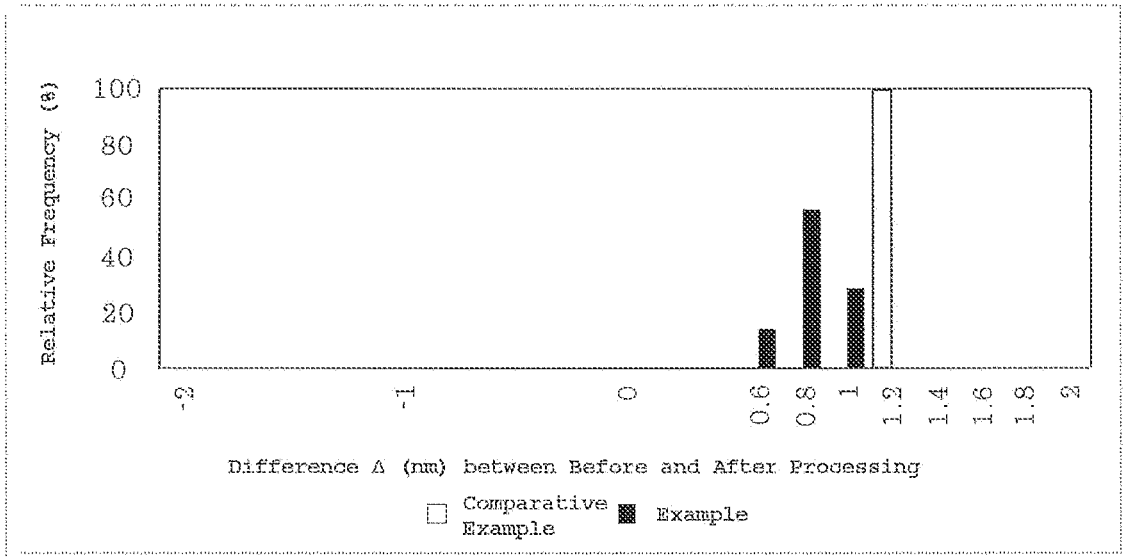
[FIG. 7]
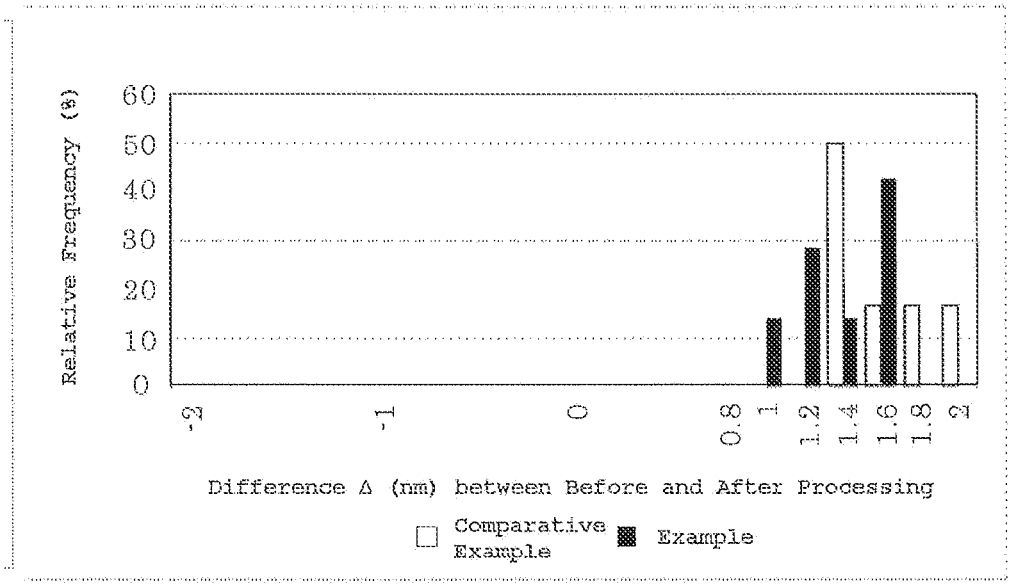
[FIG. 8]
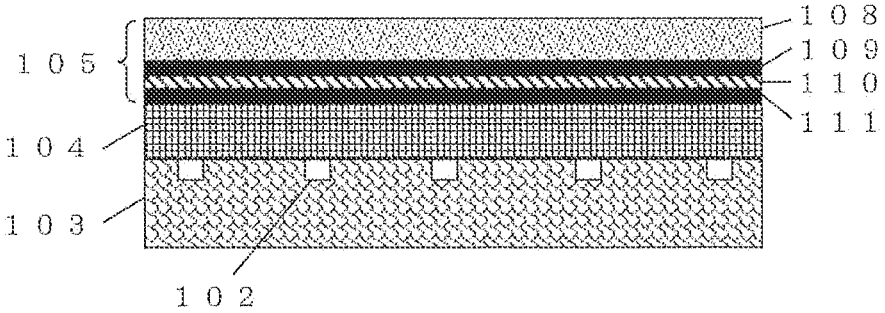

[FIG. 9]
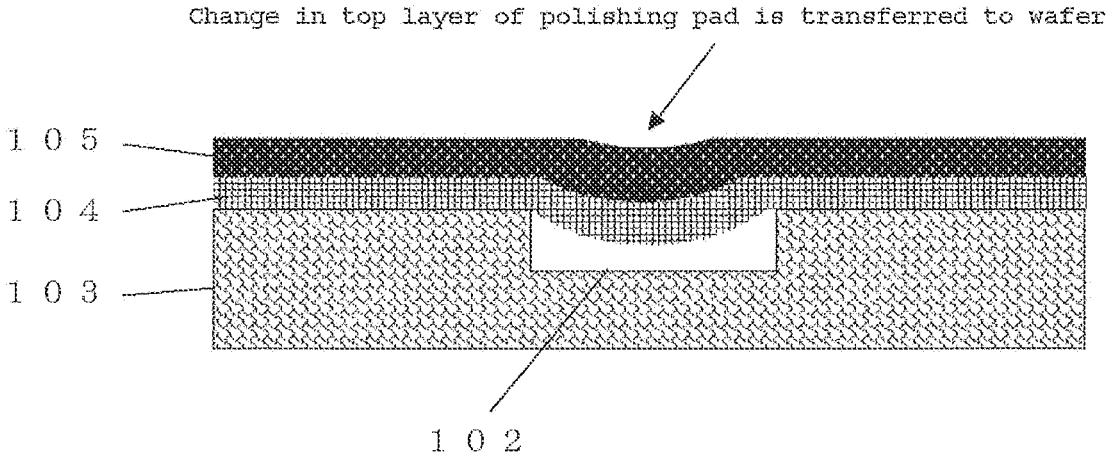

SINGLE-SIDE POLISHING APPARATUS, SINGLE-SIDE POLISHING METHOD, AND POLISHING PAD

TECHNICAL FIELD

The present invention relates to a single-side polishing apparatus, a single-side polishing method, and a polishing pad. Particularly, the present invention relates to a single-side polishing apparatus, a single-side polishing method, and a polishing pad which suppress nanotopography (hereinafter, also referred to as NT) degradation of a wafer after polishing.

BACKGROUND ART

Single-side polishing (CMP) (e.g., Patent Document 1) which is employed in polishing semiconductor wafers is performed according to a method in which a polishing pad is started up in an apparatus different from a processing apparatus (polishing apparatus) and interchanged together with a turntable between the apparatuses. This is because of concern that the apparatus working efficiency might be lowered by initial polishing after polishing-pad replacement.

As the process of detaching and attaching a turntable, a process is employed in which a detachable polishing turntable (hereinafter, also referred to as detachable turntable) is immobilized by vacuum suction on a base turntable (e.g., made of ceramic) of the apparatus. In the vacuum suction process, concentric or radial groove paths are formed on the base turntable side, and the detachable turntable is mounted over the grooves, followed by vacuum suction. It has been known that this vacuum suction process has a problem that the detachable turntable with a thickness of 20 mm or less is deformed by vacuum suction. At present, detachable turntables having a turntable thickness of 20 mm or more and 30 mm or less are employed.

In these cases, the influence during the turntable vacuum suction causes no problem for the detachable turntable if a polishing pad (non-woven fabric-type) has a hardness (Asker C) of 60, a compressibility of 18%, and a thickness of 1.3 mm and a processing raw material has a NT quality level of about 6 nm based on NT (SQMM)_2 mm and 13 nm based on NT (SQMM) 10 mm.

Recently, to suppress creep deformation at the top layer of a polishing pad for flatness quality enhancement, the polishing pad is hardened and employed with a thickness of 0.8 mm or less, a hardness (Asker C) of 63, and a compressibility of 12%. The NT quality improvement also progresses in a different process, so that the NT quality of a raw material supplied to single-side polishing is improved to 3.5 nm or less based on NT (SQMM) 2 mm and 12.0 nm or less based on NT (SQMM)_10 mm. In such a case, NT degradation in polished wafer becomes more noticeable.

CITATION LIST

Patent Literature

Patent Document 1: JP H11-277408 A

SUMMARY OF INVENTION

Technical Problem

The above-described hardened polishing pad and NT quality enhancement of raw material (wafer) before polishing process bring about a problem that the asperity on a surface for polishing a wafer is transferred to the wafer surface and degrades the NT. Specifically, a detachable turntable is deformed in such a manner as to follow the grooves of a base turntable. The deformation of the detachable turntable lightly influences the top layer of the polishing pad, and the deformation is transferred to the wafer surface. This influence is stronger when the surface NT quality of the wafer is higher. For example, when a wafer having such NT quality is subjected to polishing process, the NT after the polishing is degraded by about 1 to 2 nm in comparison with that before the polishing.

As described above, recently, the NT improvement has progressed, so that raw materials to be introduced have better quality levels of 3.5 nm or less based on the SQMM mode of 2 mm and 12.0 nm or less based on the mode of 10 mm. In such cases, the asperity transfer onto the wafer surfaces is readily observed.

The present invention has been made in view of the above problems. An object of the present invention is to provide a single-side polishing apparatus, a single-side polishing method, and a polishing pad which are capable of suppressing NT quality degradation of polished wafer in wafer single-side polishing (particularly, single-side polishing using a vacuum suction-type detachable polishing turntable).

Solution to Problem

To achieve the object, the present invention provides a single-side polishing apparatus comprising:

- a base turntable having an upper surface with a groove for vacuum suction;
- a detachable polishing turntable immobilized on the upper surface of the base turntable by vacuum suction;
- a polishing pad attached to the polishing turntable; and
- a polishing head configured to hold a wafer, wherein the single-side polishing apparatus is configured to bring a surface of the wafer held by the polishing head into sliding contact with the polishing pad to polish the surface,
- the polishing pad comprises a polishing layer configured to polish the surface of the wafer, a first adhesive layer, a PET sheet layer, a second adhesive layer, an elastic layer, and a third adhesive layer for attachment to the polishing turntable, and the layers are sequentially stacked, and
- the polishing pad has a compressibility of 16% or more.

As described above, particularly the PET sheet layer and the elastic layer are provided, and the polishing pad as a whole has a compressibility of 16% or more. With these, even if the polishing turntable and the polishing pad are lightly deformed by vacuum suction in such a manner as to follow the groove for vacuum suction in the base turntable, the deformations are absorbed by the elastic layer of the polishing pad. The PET sheet layer is capable of maintaining a flat reference surface (which is the polish-processing surface of the polishing pad, and which comes into contact with a wafer), thereby successfully preventing asperity on the polishing pad. Preventing the asperity on the polish-processing surface of the polishing pad makes it possible to suppress NT degradation of the polished wafer which would be otherwise conventionally caused by groove for vacuum suction.

Optionally, in this case, the elastic layer comprises: a PET base; and a silicone sheet located on the PET base and made of a thermally crosslinked silicone resin, the PET base is positioned on the second adhesive layer side, the silicone sheet is positioned on the third adhesive layer side, and the silicone sheet has a thickness of 30 μm or more and 500 μm or less.

The elastic layer formed of these materials can more effectively absorb the aforementioned deformations caused by groove for vacuum suction.

Moreover, when the silicone sheet has a thickness of 30 μm or more, the thickness variation of the silicone sheet can be further reduced. Meanwhile, with the thickness of 500 μm or less, the flatness degradation (particularly, along the outer peripheral portion) of the silicone sheet can be suppressed. As described above, the thickness within this numerical range is preferable in view of thickness variation and flatness, and it is possible to suppress adverse influence on the wafer polishing.

Further, the PET sheet layer can have a thickness of 100 μm or more and 350 μm or less.

The PET sheet layer having a thickness of 100 μm or more as described above can more effectively maintain the flat reference surface. Meanwhile, with the thickness of 350 μm or less, such a layer can be readily formed from a single PET-made sheet.

Moreover, the present invention provides a single-side polishing method using a single-side polishing apparatus including a base turntable, a polishing turntable immobilized on the base turntable by vacuum suction, a polishing pad attached to the polishing turntable, and a polishing head configured to hold a wafer, the method comprising bringing a surface of the wafer held by the polishing head into sliding contact with the polishing pad to polish the surface, wherein as the single-side polishing apparatus, the above-described inventive single-side polishing apparatus is used for the polishing.

According to such a single-side polishing method, the elastic layer of the polishing pad absorbs the deformations caused by groove for vacuum suction, and the PET sheet layer maintains the flat reference surface. These enable polishing while preventing the asperity on the polishing pad. Consequently, the asperity on the polish-processing surface of the polishing pad is prevented, making it possible to suppress NT degradation of the polished wafer.

Further, the present invention provides a polishing pad configured to polish a surface of a wafer while attached to a polishing turntable of a single-side polishing apparatus, wherein the polishing pad comprises a polishing layer configured to polish the surface of the wafer, a first adhesive layer, a PET sheet layer, a second adhesive layer, an elastic layer, and a third adhesive layer for attachment to the polishing turntable, and the layers are sequentially stacked, and the polishing pad has a compressibility of 16% or more.

Such a polishing pad is quite effective particularly in polishing a wafer while the polishing pad is attached to a detachable polishing turntable immobilized by vacuum suction to the upper surface with a groove for vacuum suction of a base turntable. The polishing pad is capable of suppressing NT degradation of the polished wafer which would be otherwise caused by the groove for vacuum suction.

Advantageous Effects of Invention

As described above, the single-side polishing apparatus, single-side polishing method, and polishing pad of the present invention make it possible to suppress NT quality degradation of polished wafer in wafer single-side polishing.

BRIEF DESCRIPTION OF DRAWINGS

FIG. 1 is a schematic view showing an example of a single-side polishing apparatus according to the present invention.

FIG. 2 is a top view showing exemplary grooves for vacuum suction on a base turntable.

FIG. 3 is a schematic view showing an example of a polishing pad according to the present invention.

FIG. 4 is an explanatory view showing an exemplary behavior of the inventive polishing pad in which deformation caused by the groove for vacuum suction is absorbed and a flat polish-processing surface is maintained.

FIG. 5 is a graph showing a relation between the compressibility of the polishing pad and the NT degradation amount in an experiment.

FIG. 6 is a graph showing a relation between the NT (SQMM_2 nm) degradation amount (difference between before and after processing) and the relative frequency in Example and Comparative Example.

FIG. 7 is a graph showing a relation between the NT (SQMM_10 nm) degradation amount (difference between before and after processing) and the relative frequency in Example and Comparative Example.

FIG. 8 is a schematic view showing an example of a conventional polishing pad.

FIG. 9 is an explanatory view showing an exemplary behavior of a conventional product in which a polishing pad is deformed due to groove for vacuum suction, thereby causing asperity on a polish-processing surface.

DESCRIPTION OF EMBODIMENTS

As noted above, when single-side polishing is performed using a vacuum suction-type detachable polishing turntable, the polishing turntable and polishing pad are deformed due to the groove for vacuum suction of a base turntable. Recently, enhancement of wafer-surface NT quality has increased the influence of the deformations on the NT quality. Hence, the present inventors have earnestly studied and found when a polishing pad attached to a polishing turntable is a laminate sequentially including a polishing layer, a first adhesive layer, a PET sheet layer, a second adhesive layer, an elastic layer, and a third adhesive layer for attachment to the polishing turntable, and when this polishing pad has a compressibility of 16% or more, the elastic layer absorbs the above-described deformations due to groove for vacuum suction, and the PET sheet layer can maintain a flat polish-processing surface. These make it possible to prevent the asperity on the polishing pad, and to avoid NT quality degradation of the polished wafer. These findings have led to the completion of the present invention.

Hereinafter, embodiments of the present invention will be described with reference to the drawings, but the present invention is not limited thereto.

FIG. 1 shows an exemplary schematic of a single-side polishing apparatus according to the present invention. Note that a wafer-polishing step includes, for example, a primary polishing step (double-side polishing apparatus), a secondary polishing step (single-side polishing apparatus: non-woven fabric-type polishing pad), and a finish polishing step (single-side polishing apparatus: suede-type polishing pad). The inventive single-side polishing apparatus is suitably used in a secondary polishing step. However, the prevent invention is not limited to this polishing. Then, as shown in FIG. 1, this single-side polishing apparatus 1 has: a base turntable 3 having an upper surface with a groove 2 for vacuum suction; a detachable polishing turntable 4 (e.g., thickness: 30 mm or less) immobilized on the upper surface of the base turntable 3 by vacuum suction; a polishing pad 5 according to the prevent invention attached to the polishing turntable 4; a polishing head 6 configured to hold a wafer W; and a nozzle 7 configured to supply a slurry onto the polishing pad 5.

The base turntable 3 is capable of vacuum sucking the polishing turntable 4 on the upper surface by utilizing the groove 2. Moreover, the base turntable 3 is rotatable, and the vacuum-sucked polishing turntable 4 is also rotatable together. In addition, the polishing head 6 is configured to hold the wafer W during the polishing, and to bring a surface of the wafer W into sliding contact with the polishing pad 5 to polish the wafer W. The base turntable 3, the polishing turntable 4, the polishing head 6, and the nozzle 7 themselves are not particularly limited. For example, the same parts as conventional ones can be used.

Note that an example of the groove 2 for vacuum suction of the base turntable 3 is shown in a top view of FIG. 2. In the example shown in FIG. 2, multiple concentric multiple grooves and radially-extending multiple grooves are formed in combination. Nevertheless, the groove 2 is not limited, and there may be only concentric multiple grooves or only radially-extending multiple grooves. Alternatively, there may be a groove having even another shape. The number and depth are not particularly limited, as long as the polishing turntable 4 can be vacuum-sucked appropriately.

FIG. 3 shows one example of the inventive polishing pad 5. Note that, to facilitate the understanding of the positional relation of the layers, the turntables (the base turntable 3 and the polishing turntable 4) are also illustrated.

The polishing pad 5 is constituted of, sequentially from the top surface side (which is a side of the polish-processing surface, and which comes into contact with the wafer W to be polished) toward the polishing turntable 4, a polishing layer 8, a first adhesive layer 9, a PET (polyethylene terephthalate) sheet layer 10, a second adhesive layer 11, an elastic layer 12, and a third adhesive layer 13.

The polishing layer 8 is not particularly limited, as long as it is capable of polishing the wafer W. The polishing layer 8 may be made of, for example, a non-woven fabric. Examples of the material include natural fibers, such as cotton, hemp, silk, and hair; chemical fibers, such as rayon, cupra, lyocell, acetate, triacetate, polyester, nylon, acrylic, vinylon, polypropylene, polyurethane, and polyphenylene sulfide; etc. The non-woven fabric is preferably nylon fiber impregnated with polyurethane, and the thickness can be set about 0.8 to 1.5 mm by buffing.

The first adhesive layer 9, the second adhesive layer 11, and the third adhesive layer 13 are not particularly limited, as long as the upper and lower layers or the turntable can be immobilized to one another by adhesion. For example, the material can be natural rubber type or acrylic type. The first adhesive layer 9, the second adhesive layer 11, and the third adhesive layer 13 can have thicknesses of respectively about 30 to 50 μm, 30 to 50 μm, and 10 to 30 μm.

Moreover, the PET sheet layer 10 can be, for example, a sheet shape and made of PET material as commercially available. The thickness is not particularly limited, and can be, for example, 100 μm or more and 350 μm or less. With the thickness of 100 μm or more, the flat polish-processing surface can be maintained more effectively. Alternatively, the PET sheet layer 10 can be formed thick by disposing multiple sheets. Nevertheless, the thickness of about 350 μm is sufficient to maintain the flatness of the polish-processing surface. Further, such thickness is convenient because only one sheet can constitute the PET sheet layer 10. Preferably, the thickness can be about 188±10% (170 μm to 207 μm).

Furthermore, the thickness variation is not particularly limited, either, and can be within a range of, for example, about 2 to 8%. The smaller the thickness variation, the more preferable in view of maintaining the flatness of the polish-processing surface.

Additionally, the elastic layer 12 is not particularly limited, as long as it is made of an elastic material that easily and sufficiently absorbs deformation due to the groove 2 for vacuum suction. Preferably, the elastic layer 12 can have a PET base 14, and a silicone sheet 15 located on a surface of the PET base 14 and made of a thermally-crosslinked silicone resin. The PET base 14 is positioned on the second adhesive layer 11 side, and the silicone sheet 15 is positioned on the third adhesive layer 13 side. As an example, the PET base 14 having a thickness of 25 μm may be coated with a coating solution containing a silicone resin composed of polyorganosiloxane (molecular weight: 5000 to 30000) and baked at 150° C. to prepare the crosslinked silicone sheet 15 (thickness: 30 μm to 500 μm). Such materials facilitate further effective absorption of the deformations due to the groove 2. Additionally, when the thickness is 30 μm or more, the silicone sheet 15 with smaller thickness variation is easily prepared. Meanwhile, the thickness of 500 μm or less is more preferable because it is possible to suppress the flatness degradation (particularly, along the outer peripheral portion).

In the above example, the silicone resin is thermally crosslinked but may be a silicone sponge etc.

Furthermore, the inventive polishing pad 5 particularly including the PET sheet layer 10 and the elastic layer 12 has a compressibility of 16% or more as a whole in a thickness direction thereof. The upper limit value of the compressibility is not particularly limited, but for example 30% is sufficient. Considering maintaining the flatness of the polish-processing surface during the polishing, more preferable upper limit value is this value or so.

If the compressibility is less than 16%, the deformations due to the groove 2 cannot be absorbed sufficiently during the polishing, so that the polishing pad has uneven surface, and the NT quality of the polished wafer is degraded. In contrast, the inventive polishing pad 5 is capable of effectively absorbing the deformations and suppressing the asperity by maintaining the surface flatness, so that NT quality degradation of the polished wafer can be prevented.

For example, in a case of conventional product as shown in FIG. 8, a polishing pad 105 includes a polishing layer 108 (0.8 mm), a first adhesive layer 109 (40 μm), a PET sheet layer 110 (25 μm), and a second adhesive layer 111 (40 μm) which are stacked on a polishing turntable 104 vacuum-sucked to a base turntable 103 (with grooves 102 for vacuum suction). This conventional product has a compressibility of about 12%. The polishing pad 105 cannot completely absorb deformations caused by the groove 102 as shown in FIG. 9, and the deformations remain as asperity on the surface of the polishing pad 105. This asperity is transferred to the wafer surface to be polished, and adversely influences the NT quality.

In contrast, in the inventive polishing pad 5 in the example shown in FIG. 4, the polishing layer 8 (0.8 mm), the first adhesive layer 9 (40 μm), the PET sheet layer 10 (188 μm), the second adhesive layer 11 (40 μm), the elastic layer 12 (the 25-μm PET base 14 and the 30-μm silicone sheet 15), and the third adhesive layer 13 (10 μm) are stacked, and the polishing pad 5 has a compressibility of 16%. In the inventive product as described above, the polishing pad 5 sufficiently absorbs the deformations due to the groove 2 and successfully maintains the flat polish-processing surface, so that the NT quality degradation of the polished wafer can be suppressed.

Note that, in the present invention, the compressibility is based on JIS L-1096. As a measurement method of the compressibility, first, three test pieces (polishing pads) are placed on one another, an initial load W0 (50 gf/cm$^2$) is applied thereto, and a thickness T1 is read one minute thereafter. Simultaneously, a higher load W1 (300 gf/cm$^2$) is applied, and a thickness T2 is read one minute thereafter. Then, the compressibility is determined according to the following formula.

Note that as the thickness measurement machine, SE-15 manufactured by INTEC CO., LTD. was used.

$$\text{Compressibility (\%)} = \frac{T1 - T2}{T1} \times 100$$

Now, description will be given of an experiment by which the present inventors have found the criterion that is a compressibility of 16%.

To assign the compressibility of a polishing pad, elastic-layer resins (silicone sheets) and PET sheet layers were prepared each of which had various thicknesses. Wafers were subjected to only a secondary polishing process. The NT degradation amounts after the processing were measured with WS2 (WaferSight 2 manufactured by KLA-Tencor) to examine a relation between polishing pad compressibility and NT quality (SQMM modes: 2 mm/10 mm).

Regarding the PET sheet layer thicknesses, each sheet was prepared to have a thickness variation of 5% or less, and the thicknesses were set at four levels: 25, 50, 188, and 350 μm. Regarding the silicone sheet thicknesses in the elastic layer, 25-μm PET bases were coated with a coating solution containing a silicone resin (molecular weight: 30000) in different amounts so as to result in thicknesses of 10, 30, 100, and 500 μm, followed by baking for crosslinking. The compressibility was examined with respect to polishing pads each constituted of: polishing layer (non-woven fabric, thickness: 0.8 mm)+first adhesive layer (40 μm)+PET sheet layer+second adhesive layer (40 μm)+elastic layer (25-μm PET base+silicone sheet)+third adhesive layer (10 μm). The compressibility was assigned as 12, 14, 15, 16, 18, and 20%. Note that in the case where the compressibility was 12%, the same configuration as that in FIG. 8 was employed: polishing layer+first adhesive layer (40 μm)+PET sheet layer (25 μm)+second adhesive layer (40 μm).

Each polishing pad with the assigned compressibility was attached to a polishing turntable, wafers were polished, and then NT was measured. In the polishing process, colloidal silica-containing slurry was used, and single-side polishing was performed on wafers having a diameter of 300 mm ($P^-$ products; plane orientation <100>; NT (SQMM)_2 mm=3.5 nm or less and NT (SQMM)_10 mm=12.0 nm or less after primary polishing).

Table 1 summarizes items: the compressibility of the polishing pad, the thickness of the PET sheet layer, the thickness of the resin (silicone sheet) in the elastic layer, the NT degradation amount (each represents an average value of three wafers), and whether NT degradation was good or poor. Note that regarding whether NT degradation was good or poor, if the NT degradation amount based on the SQMM mode of 2 mm was less than 1.0 nm on average and that based on the SQMM mode of 10 mm was less than 1.4 nm on average, the product was evaluated as passed (good). Meanwhile, if the amounts were respectively 1.0 nm or more and 1.4 nm or more, the product was evaluated as failed (poor).

Moreover, FIG. 5 shows a relation between the compressibility of the polishing pad and the NT degradation amount. "•" represents a case based on the SQMM mode of 2 mm, and "x" represents a case based on the SQMM mode of 10 mm.

TABLE 1

| Compressibility (%) | PET sheet layer thickness (μm) | Resin thickness (μm) in elastic layer | Remarks | NT degradation amount (nm) 2 mm□ | NT degradation amount (nm) 10 mm□ | Whether NT degradation was good or poor |
|---|---|---|---|---|---|---|
| 20 | 350 | 500 | silicone molecular weight: about 30000 | 0.41 | 0.99 | good |
| 18 | 188 | 100 | silicone molecular weight: about 30000 | 0.66 | 1.13 | good |
| 16 | 188 | 30 | silicone molecular weight: about 30000 | 0.72 | 1.12 | good |
| 15 | 50 | 30 | silicone molecular weight: about 30000 | 1.11 | 1.61 | poor |
| 14 | 188 | 10 | silicone molecular weight: about 30000 | 1.18 | 1.50 | poor |
| 12 | 25 | none | | 1.44 | 2.09 | poor |

The following trends were found that: from the conventional products with a compressibility of 12 to 15%, the NT degradation amounts between before and after the processing were large; meanwhile, from the inventive products with a compressibility of 16% or more, the degradation amounts were small. This is presumably because the inventive polishing pad includes an elastic layer and a PET sheet layer and has a compressibility of 16% or more, so that slight deformations caused by the groove for vacuum-sucking the polishing turntable were absorbed, and the polish-processing surface was successfully maintained.

Incidentally, whether NT degradation was good or poor was similarly examined for a case where: the compressibility was 16%, the PET sheet layer thickness was 100 μm, and the resin thickness in the elastic layer was 30 μm. The result was evaluated as passed.

Based on such an experiment, the present inventors have found that the critical value of the compressibility of the polishing pad was 16%.

Additionally, in a single-side polishing method according to the present invention, a surface of the wafer W is polished using the inventive single-side polishing apparatus 1 including the inventive polishing pad 5 as shown in FIGS. 1 and 3. Specifically, the polishing turntable 4 is mounted on the upper surface of the base turntable 3, and the polishing turntable 4 is immobilized by vacuum suction utilizing the groove 2. The polishing pad 5 is attached to the upper surface of the polishing turntable 4. Meanwhile, the polishing head 6 holds the wafer W. While slurry is being supplied from the nozzle 7, each of the polishing head 6 and the base turntable 3 (and the polishing turntable 4) is rotated to bring the surface of the wafer W into sliding contact with the polishing pad 5 for the polishing process.

Since the polishing pad 5 can absorb the deformations due to the groove 2 to thereby keep the polish-processing surface flat as described above, it is possible to suppress NT degradation of the polished wafer.

EXAMPLE

Hereinafter, the present invention will be more specifically described by showing Example of the present invention and Comparative Example, but the present invention is not limited thereto.

EXAMPLE

The inventive single-side polishing apparatus including the inventive polishing pad as shown in FIGS. 1 and 3 was used to perform wafer polishing process. The polishing pad had a configuration of polishing layer (non-woven fabric, thickness: 0.8 mm)+first adhesive layer (40 μm)+PET sheet layer (188 μm)+second adhesive layer (40 μm)+elastic layer (25-μm PET base+30-μm silicone sheet)+third adhesive layer (10 μm), and had a compressibility of 16%.

The polishing pad was attached to a ceramic detachable turntable (polishing turntable). After the polishing pad was started up, the resultant was attached to a base turntable by vacuum suction, and polishing process was performed. For the polishing, a colloidal silica-type KOH-based polishing agent (slurry) was used. The processing raw materials were wafers after primary polishing having a diameter of 300 mm and were P-products with a plane orientation of <100>. NT (SQMM)_2 mm was 3.5 nm or less, and NT (SQMM)_10 mm was 12.0 nm or less.

With WaferSight 2, the NT was measured before and after the processing. The NT degradation amounts after the polishing were calculated, and the average value was obtained.

COMPARATIVE EXAMPLE

A conventional single-side polishing apparatus including a conventional polishing pad as shown in FIG. 8 was used to perform wafer polishing process. The polishing pad had a configuration of polishing layer (non-woven fabric, thickness: 0.8 mm)+first adhesive layer (40 μm)+PET sheet layer (25 μm)+second adhesive layer (40 μm), and had a compressibility of 12%.

Except these, the polishing process, NT measurement before and after the processing, and NT-degradation-amount (average value) calculation after the polishing were performed as in Example.

FIG. 6 shows a relation between the NT (SQMM 2 nm) degradation amount (difference between before and after processing) and the relative frequency in Example and Comparative Example; Table 2 shows the average values of the degradation amounts. Moreover, FIG. 7 shows the relation for NT (SQMM_10 nm); Table 3 shows the average values of the degradation amounts.

TABLE 2

| NT degradation amount (nm) | Comparative Example | Example |
|---|---|---|
| Ave | 1.122 | 0.723 |
| Max | 1.18 | 0.90 |
| Min | 1.04 | 0.55 |
| s | 0.049 | 0.127 |

TABLE 3

| NT degradation amount (nm) | Comparative Example | Example |
|---|---|---|
| Ave | 1.463 | 1.284 |
| Max | 1.84 | 1.57 |
| Min | 1.24 | 0.95 |
| s | 0.235 | 0.244 |

The comparison of the NT degradation amounts shows that processing with the inventive polishing pad (single-side polishing apparatus) resulted in smaller degradation amounts that those caused by processing with the polishing pad (single-side polishing apparatus) as the conventional product. The NT (SQMM_2 nm) degradation amount (average) according to the present invention was about 0.7 nm, that is, less than 1.0 nm; in contrast, that of the conventional product was 1.0 nm or more. Moreover, the NT (SQMM_10 nm) degradation amount (average) according to the present invention was about 1.3 nm, that is, less than 1.4 nm; in contrast, that of the conventional product was 1.4 nm or more. From the foregoing, it was verified that even when a raw material (wafer) is in a condition with favorable NT level before processing and thus susceptible to groove-derived deformations, the NT quality degradation is successfully suppressed and the condition is maintained at a level equivalent to that before the processing.

It should be noted that the present invention is not limited to the above-described embodiments. The embodiments are just examples, and any embodiments that substantially have the same feature and demonstrate the same functions and effects as those in the technical concept disclosed in claims of the present invention are included in the technical scope of the present invention.

The invention claimed is:

1. A single-side polishing apparatus comprising:

a base turntable having an upper surface with a groove for vacuum suction;

a detachable polishing turntable immobilized on the upper surface of the base turntable by vacuum suction;

a polishing pad attached to the polishing turntable; and a polishing head configured to hold a wafer, wherein the single-side polishing apparatus is configured to bring a surface of the wafer held by the polishing head into sliding contact with the polishing pad to polish the surface, the polishing pad comprises a polishing layer configured to polish the surface of the wafer, a first adhesive layer, a PET sheet layer, a second adhesive layer, an elastic layer, and a third adhesive layer for attachment to the polishing turntable, and the layers are sequentially stacked, and the polishing pad has a compressibility value, measured according to standard JIS L-1096, of 16% or more.

2. The single-side polishing apparatus according to claim 1, wherein the elastic layer comprises: a PET base; and a silicone sheet located on the PET base and made of a thermally crosslinked silicone resin, the PET base is positioned on the second adhesive layer side, the silicone sheet is positioned on the third adhesive layer side, and the silicone sheet has a thickness of 30 μm or more and 500 μm or less.

3. The single-side polishing apparatus according to claim 1, wherein the PET sheet layer has a thickness of 100 μm or more and 350 μm or less.

4. The single-side polishing apparatus according to claim 2, wherein the PET sheet layer has a thickness of 100 μm or more and 350 μm or less.

5. A single-side polishing method using a single-side polishing apparatus including the base turntable, the polishing turntable immobilized on the base turntable by vacuum suction, the polishing pad attached to the polishing turntable, and the polishing head configured to hold the wafer, the method comprising bringing the surface of the wafer held by the polishing head into sliding contact with the polishing pad to polish the surface, wherein as the single-side polishing apparatus, the single-side polishing apparatus according to claim 1 is used for the polishing.

6. A single-side polishing method using a single-side polishing apparatus including the base turntable, the polishing turntable immobilized on the base turntable by vacuum suction, the polishing pad attached to the polishing turntable, and the polishing head configured to hold the wafer, the method comprising bringing a surface of the wafer held by the polishing head into sliding contact with the polishing pad to polish the surface, wherein as the single-side polishing apparatus, the single-side polishing apparatus according to claim 2 is used for the polishing.

7. A single-side polishing method using a single-side polishing apparatus including the base turntable, the polishing turntable immobilized on the base turntable by vacuum suction, the polishing pad attached to the polishing turntable, and the polishing head configured to hold the wafer, the method comprising bringing a surface of the wafer held by the polishing head into sliding contact with the polishing pad to polish the surface, wherein as the single-side polishing apparatus, the single-side polishing apparatus according to claim 3 is used for the polishing.

8. A single-side polishing method using a single-side polishing apparatus including the base turntable, the polishing turntable immobilized on the base turntable by vacuum suction, the polishing pad attached to the polishing turntable, and the polishing head configured to hold the wafer, the method comprising bringing a surface of the wafer held by the polishing head into sliding contact with the polishing pad to polish the surface, wherein as the single-side polishing apparatus, the single-side polishing apparatus according to claim 4 is used for the polishing.

9. A polishing pad configured to polish a surface of a wafer while attached to a polishing turntable of a single-side polishing apparatus, wherein the polishing pad comprises a polishing layer configured to polish the surface of the wafer, a first adhesive layer, a PET sheet layer, a second adhesive layer, an elastic layer, and a third adhesive layer for attachment to the polishing turntable, and the layers are sequentially stacked, and the polishing pad has a compressibility value, measured according to standard JIS L-1096, of 16% or more.

* * * * *